US011255602B2

(12) United States Patent
Zielinski et al.

(10) Patent No.: US 11,255,602 B2
(45) Date of Patent: Feb. 22, 2022

(54) METHOD FOR LIQUEFYING NATURAL GAS AND FOR RECOVERING POSSIBLE LIQUIDS FROM THE NATURAL GAS, COMPRISING TWO REFRIGERANT CYCLES SEMI-OPEN TO THE NATURAL GAS AND A REFRIGERANT CYCLE CLOSED TO THE REFRIGERANT GAS

(71) Applicant: SAIPEM S.P.A., Montigny le Bretonneux (FR)

(72) Inventors: Eric Zielinski, Versailles (FR); Nathalie Trichard, Montigney-le-Bretonneux (FR); Julien Bellande, Versailles (FR); Benjamin Rodier, Courbevoie (FR)

(73) Assignee: Saipem S.P.A., San Donato Milanese (IT)

( * ) Notice: Subject to any disclaimer, the term of this patent is extended or adjusted under 35 U.S.C. 154(b) by 511 days.

(21) Appl. No.: 16/315,115

(22) PCT Filed: Jun. 20, 2017

(86) PCT No.: PCT/FR2017/051630
§ 371 (c)(1),
(2) Date: Jan. 3, 2019

(87) PCT Pub. No.: WO2018/007710
PCT Pub. Date: Jan. 11, 2018

(65) Prior Publication Data

US 2019/0310013 A1 Oct. 10, 2019

(30) Foreign Application Priority Data

Jul. 6, 2016 (FR) ..... 1656460

(51) Int. Cl.
*F25J 1/02* (2006.01)
*F25J 1/00* (2006.01)

(52) U.S. Cl.
CPC ..... *F25J 1/0022* (2013.01); *F25J 1/004* (2013.01); *F25J 1/005* (2013.01); *F25J 1/0035* (2013.01);
(Continued)

(58) Field of Classification Search
CPC ..... F25J 1/0022; F25J 1/005; F25J 1/0283; F25J 1/0258; F25J 1/0208; F25J 1/0231;
(Continued)

(56) References Cited

U.S. PATENT DOCUMENTS 4,012,212 A 3/1977 Kniel
4,157,904 A 6/1979 Campbell et al.
(Continued)

FOREIGN PATENT DOCUMENTS

FR 2 317 609 2/1977
FR 2 977 015 12/2012
(Continued)

OTHER PUBLICATIONS

Howe et al., "Capital Cost and Efficiency Data for the ZR-LNG Dual Methane Expander Liquefaction Technology," Gastech Singapore, Oct. 2015, 7 pages.
(Continued)

*Primary Examiner* — Brian M King
(74) *Attorney, Agent, or Firm* — Cozen O'Connor

(57) ABSTRACT

A process for liquefying a natural gas comprising a mixture of hydrocarbons predominating in methane, the process comprising a first semi-open refrigerant cycle with natural gas in which any natural gas liquids that have condensed are separated from the natural gas feed stream, which stream then passes through a main cryogenic heat exchanger (4) in
(Continued)

order to contribute by heat exchange to pre-cooling a main natural gas stream (F-P) and to cooling an initial refrigerant gas stream (G-0), a second semi-open refrigerant cycle with natural gas for contributing to pre-cooling the natural gas and the refrigerant and also to liquefying the natural gas, and a closed refrigerant cycle with refrigerant gas for subcooling the liquefied natural gas and for delivering refrigeration power in addition to the other two cycles. The invention also provides a natural gas liquefaction installation for performing such a process.

16 Claims, 5 Drawing Sheets

(52) U.S. Cl.
CPC ..... *F25J 1/0037* (2013.01); *F25J 1/0072* (2013.01); *F25J 1/0095* (2013.01); *F25J 1/0097* (2013.01); *F25J 1/0208* (2013.01); *F25J 1/0209* (2013.01); *F25J 1/029* (2013.01); *F25J 1/0231* (2013.01); *F25J 1/0237* (2013.01); *F25J 1/0278* (2013.01); *F25J 1/0283* (2013.01); *F25J 1/0288* (2013.01); *F25J 2220/60* (2013.01); *F25J 2220/62* (2013.01); *F25J 2220/64* (2013.01); *F25J 2230/20* (2013.01)

(58) Field of Classification Search
CPC ..... F25J 1/0237; F25J 1/0219; F25J 1/0047; F25J 1/0035; F25J 1/0032; F25J 2220/64; F25J 2220/60; F25J 2230/20
See application file for complete search history.

(56) References Cited

U.S. PATENT DOCUMENTS

| | | | | |
|---|---|---|---|---|
| 4,430,103 | A | 2/1984 | Gray et al. | |
| 5,036,671 | A * | 8/1991 | Nelson | F25J 1/0055 62/612 |
| 7,234,322 | B2 * | 6/2007 | Hahn | F25J 3/0257 62/620 |
| 10,641,548 | B2 † | 5/2020 | Skinner | |
| 2010/0186445 | A1 * | 7/2010 | Minta | F25J 1/0037 62/606 |
| 2013/0118204 | A1 * | 5/2013 | Higginbotham | F25J 1/0012 62/615 |
| 2014/0083132 | A1 * | 3/2014 | Maunder | F25J 1/0037 62/611 |

FOREIGN PATENT DOCUMENTS

| | | |
|---|---|---|
| GB | 2486036 | † 11/2012 |
| WO | WO 97/13109 | 4/1997 |
| WO | WO 2007/021351 | 2/2007 |
| WO | WO 2013/057314 | 4/2013 |

OTHER PUBLICATIONS

Howe et al., "Zero Refrigerant Liquefaction Developments in the ZR-LNG Technology," Presented at the Spring Meeting of Gas Processors Association Europe, May 2019, Amsterdam, 16 pages.
Third Party Observation dated Jul. 31, 2020 issued in European Patent Application No. 17745789.2, 4 pages.

* cited by examiner
† cited by third party

METHOD FOR LIQUEFYING NATURAL GAS AND FOR RECOVERING POSSIBLE LIQUIDS FROM THE NATURAL GAS, COMPRISING TWO REFRIGERANT CYCLES SEMI-OPEN TO THE NATURAL GAS AND A REFRIGERANT CYCLE CLOSED TO THE REFRIGERANT GAS

PRIORITY CLAIM

This is a U.S. national stage of application No. PCT/FR2017/051630, filed on Jun. 20, 2017. Priority is claimed on France Application No. FR1656460, filed Jul. 6, 2016, the content of which is incorporated here by reference.

BACKGROUND OF THE INVENTION

The present invention relates to the general field of liquefying natural gas predominating in methane, in order to produce liquefied natural gas (LNG).

A particular but non-limiting field of application of the invention is that of floating liquefaction of natural gas (FLNG) installations that serve to liquefy natural gas offshore, on board a vessel, or on any other floating support at sea.

The natural gas predominating in methane that is used for producing LNG is either a by-product from oil fields, i.e. it is produced in association with crude oil, in which case it is in low or medium quantities, or else it is a major product from a gas field.

When natural gas is associated in small quantities with crude oil, it is generally treated and separated and then re-injected into the oil well, exported by pipe line, and/or used on site, in particular as fuel for powering electrical power generators, ovens, or boilers.

Conversely, when the natural gas comes from gas fields and is produced in large quantities, it is preferred to transport it so as to be able to use it in regions other than the regions where it is produced. For this purpose, natural gas can be transported in the tanks of specialized transport ships (known as "methane tankers") in the form of a cryogenic liquid (at a temperature of about −160° C.) and at a pressure close to ambient atmospheric pressure.

Natural gas is generally liquefied for transport purposes in the proximity of the gas production site, and that requires large-scale installations and considerable quantities of mechanical energy for production capacities that may be as great as several million (metric) tonnes per year. The mechanical energy needed for the liquefaction process may be produced on the site of the liquefaction installation by using some of the natural gas as fuel.

Prior to liquefaction, natural gas needs to be subjected to treatment in order to extract acid gases (in particular carbon dioxide), water (in order to avoid it freezing in the liquefaction installation), mercury (in order to avoid any risk of degrading equipment made of aluminum in the liquefaction installation), and some of the natural gas liquids (NGLs). The NGLs comprise all of the hydrocarbons heavier than methane that are present in the natural gas and that can be condensed. NGLs comprise in particular ethane, liquefied petroleum gases (LPGs) (i.e. propane and butanes), pentanes, and hydrocarbons heavier than pentanes and present in the natural gas. Among those hydrocarbons, it is particularly critical to extract, upstream from liquefaction installations: benzene; the major fraction of pentanes; and other heavier hydrocarbons in order to avoid them freezing in the liquefaction installation. Furthermore, extracting LPG and ethane can also be necessary in order to ensure that the LNG satisfies commercial specifications for heat capacity or in order to produce these products commercially.

The extraction of NGLs is either integrated within the natural gas liquefaction installation, or else it is performed in a dedicated unit upstream from the liquefaction installation. When integrated, the extraction is generally performed at a pressure that is relatively high (of the order of 4 megapascals (MPa) to 5 MPa), and when upstream it is usually performed at lower pressure (of the order of 2 MPa to 4 MPa).

NGL extraction that is integrated in the liquefaction of natural gas, as described for example in publication U.S. Pat. No. 4,430,103, presents the advantage of being simple. Nevertheless, that type of process operates only at a pressure lower than the critical pressure of the gas for liquefying, which is detrimental to the efficiency of liquefaction. Furthermore, that type of process typically separates natural gas from NGLs at a pressure of the order of 4 MPa to 5 MPa. Unfortunately, at such pressures, the selectivity with which NGLs are extracted is low. Specifically, a significant quantity of methane is extracted together with the NGL. Downstream treatment is then generally needed in order to reject the methane.

Furthermore, at a pressure of the order of 4 MPa to 5 MPa, the densities of the liquid and of the natural gas are relatively close, which makes separator drums and distillation columns difficult to design and operate (in particular in the context of an application on a floating support).

Extracting NGLs at a pressure of the order of 2 MPa to 4 MPa upstream from the liquefaction installation in a dedicated unit, e.g. as described in publication U.S. Pat. No. 4,157,904, enables high NGL recovery rates to be achieved with good selectivity (i.e. little methane is extracted). It also makes it possible to ensure that the gas feed to the liquefaction is at the optimum pressure for liquefaction (typically at least equivalent to the critical pressure) by using a dedicated re-compressor. However, such extraction of NGLs requires a large amount of complex equipment and requires non-negligible quantities of mechanical energy for re-compressing the natural gas.

Furthermore, the way in which NGLs are extracted has a significant impact on the cost and on the complexity of the liquefaction plant concerning both the performance of the liquefaction and also the overall energy efficiency of the liquefaction plant.

Various processes for liquefying natural gas have been developed in order to optimize their overall energy efficiency. In principle, those liquefaction processes typically rely on mechanically refrigerating the natural gas that is obtained by means of one or more thermodynamic refrigeration cycles delivering the thermal power needed for cooling and liquefying the natural gas. In each thermodynamic cycle implemented in those processes, the compressed refrigerant (in the form of a gas) is cooled (and possibly condensed) by a temperature source having a temperature higher than the temperature of the refrigerated fluid and referred to as the "hot source" (water, air, some other refrigeration cycle) and is then cooled further by a stream of cold gas generated by the thermodynamic cycle itself prior to being expanded. The stream of cold refrigerant at the low temperature that results from such expansion is used for cooling the natural gas and for pre-cooling the refrigerant. The gaseous refrigerant at low pressure is compressed once more to its initial pressure level (by means of compressors driven by gas turbines, steam turbines, or electric motors).

During those thermodynamic refrigeration cycles, the power needed for refrigerating and liquefying the natural gas may be delivered either by vaporizing and heating a liquid refrigerant, with the major part of the refrigeration heat being produced by the latent heat involved during the change of state, or by heating a cold refrigerant in the form of a gas. With a refrigerant gas, the temperature of the refrigerant is typically lowered by pressure expansion through an expansion turbine (known as a "gas expander"). The cooling produced by the refrigerant is predominantly in the form of sensible heat.

With a liquid refrigerant, the temperature of the refrigerant is generally lowered by expansion through a valve and/or a liquid expansion turbine (also known as a "liquid expander"). The cooling effect produced by the refrigerant is predominantly in the form of latent heat (and to a lesser extent in the form of sensible heat). Since the latent heat is much greater than the sensible heat, the flow rates of refrigerant that are needed to obtain the same refrigeration power are greater for thermodynamic cycles having recourse to a refrigerant in the gas form than for thermodynamic cycles having recourse to a refrigerant in liquid form.

Thus, for the same liquefaction capacity, thermodynamic refrigeration cycles using a gas as refrigerant require refrigeration compressors of greater capacity and pipes of greater diameter than are needed for thermodynamic refrigeration cycles using a liquid refrigerant. Thermodynamic cycles with a gas refrigerant are also generally less efficient than thermodynamic cycles with a liquid refrigerant, in particular because of the temperature difference between the fluid that is subjected to refrigeration and the refrigerant fluid is on average greater for a gas refrigerant cycle, thereby contributing to increasing efficiency losses by irreversibility.

However, thermodynamic refrigeration cycles with a liquid refrigerant make use of greater masses of refrigerant than do gas refrigerant thermodynamic cycles. When the refrigerant fluids used are flammable or toxic, liquid refrigerant thermodynamic cycles intrinsically present a level of safety that is lower than that presented by gas refrigerant processes, in particular when comparing liquid refrigerant thermodynamic cycles using hydrocarbons as the refrigerant with thermodynamic cycles using an inert gas such as nitrogen as the refrigerant. This point is particularly critical in an environment where a large amount of equipment is concentrated in a small space, and in particular on an off-shore installation. Thermodynamic refrigeration cycles using liquid refrigerants are thus efficient but they present a certain number of drawbacks, in particular for an off-shore application on a floating support.

Various liquefaction processes using thermodynamic refrigeration cycles with gaseous refrigerant have been proposed. By way of example, the following documents U.S. Pat. No. 5,916,260, WO 2005/071333, WO 2009/130466, WO 2012/175889, and WO 2013/057314 disclose liquefaction cycles with double or triple expansion of nitrogen, in which heated nitrogen at the outlet from a heat exchanger is compressed. At the delivery from compressors, the nitrogen is cooled and expanded by turbines so as to be used for cooling and liquefying the natural gas.

Such nitrogen expansion liquefaction processes present clear advantages in terms of simplicity, of intrinsic safety, and of robustness, which make them particularly suitable for an application on an off-shore floating support. Nevertheless, those processes also present poor efficiency. Thus, a process using liquid refrigerants typically produces about 30% more LNG than does a double nitrogen expansion process (at equivalent expenditure of mechanical power).

Documents WO 2007/021351 and U.S. Pat. No. 6,412,302 also disclose natural gas liquefaction processes that combine expanding natural gas and nitrogen. Those processes enable the efficiency of liquefaction to be improved, but they do not integrate extracting NGLs in the liquefaction. Unfortunately, such extraction can require a large amount of complex equipment and/or can have a negative impact on the efficiency of the liquefaction.

Finally, Documents U.S. Pat. No. 7,225,636 and WO 2009/017414 disclose processes for liquefying natural gas that combine refrigeration cycles for liquefying the natural gas by means of a gas expander turbine with extraction of NGLs. Nevertheless, those processes present a certain number of drawbacks. In particular, in those two documents, NGLs are extracted at a pressure that is relatively high, thereby leading to poor separation selectivity, while the liquefaction of natural gas takes place at low pressure (lower than the critical pressure), which is detrimental to its efficiency.

OBJECT AND SUMMARY OF THE INVENTION

A main object of the present invention is thus to mitigate such drawbacks by proposing a liquefaction process by using gaseous refrigerant thermodynamic cycles and having efficiency that is higher than prior art liquefaction processes, while proposing a process that is simple and compact for extracting NGLs, if any, which process is integrated in the liquefaction process and provides better overall energy optimization than prior art processes.

In accordance with the invention, this object is achieved by a process for liquefying a natural gas comprising a mixture of hydrocarbons predominating in methane, the process comprising:

a) a first semi-open cycle with natural gas in which in succession:

- a natural gas feed stream at a pressure P0 previously treated to extract acid gases, water, and mercury therefrom is mixed with a natural gas stream, expanded to a pressure P1, and its temperature lowered to a temperature T1 by means of an ambient temperature expansion turbine so as to obtain condensation of any natural gas liquids contained in the natural gas;
- any natural gas liquids that have condensed are separated in a main separator from the natural gas feed stream, the stream then passing through a main cryogenic heat exchanger in order to form a first natural gas stream contributing by heat exchange firstly to pre-cooling a main natural gas stream flowing in counter-current through the main cryogenic heat exchanger, and secondly to cool an initial refrigerant gas stream flowing in counter-current through the main cryogenic heat exchanger;
- at the outlet from the main cryogenic heat exchanger, the first natural gas stream, which is at a temperature T2 higher than T1 and close to the temperature of a hot source, is compressed to a pressure P2 by means of a compressor driven by the ambient temperature expansion turbine prior to being admitted to the suction of a natural gas compressor in order to be further compressed therein to a pressure P3 higher than P2 so as to form a second natural gas stream;
- the second natural gas stream at the delivery from the natural gas compressor is in part expanded and mixed with the natural gas feed stream upstream from the ambient temperature expansion turbine, and in part forms the main natural gas stream; and a fraction of this main natural gas stream passes through the main cryogenic heat exchanger in order to be cooled therein to a temperature T3 that is low enough to enable the natural gas to liquefy;

b) a second semi-open refrigerant cycle with natural gas in which, in succession:

another fraction of the main natural gas stream is extracted from the main cryogenic heat exchanger at a temperature T4 higher than T3 in order to be directed to an intermediate expansion turbine so that its temperature is lowered by expansion to a temperature T5 lower than T4 and so as to form a third natural gas stream;

the third natural gas stream is reinjected into the main cryogenic heat exchanger in order to exchange heat so as to cool the main natural gas stream and the initial refrigerant gas stream flowing in counter-current through the main cryogenic heat exchanger; and at the outlet from the main cryogenic heat exchanger, the third natural gas stream, which is at a temperature T6 close to the temperature of the hot source, is directed to a compressor driven by the intermediate expansion turbine in order to be compressed therein and it is then cooled prior to being mixed with the first natural gas stream upstream from the natural gas compressor; and c) a closed refrigerant cycle with refrigerant gas in which, in succession:

an initial refrigerant gas stream at a temperature T7 close to the temperature of the hot source and previously compressed by a refrigerant gas compressor is caused to flow through the main cryogenic heat exchanger in order to be re-cooled therein;

at the outlet from the main cryogenic heat exchanger, the initial refrigerant gas stream, which is at a temperature T8 lower than T7, is directed to a low temperature expansion turbine so that its temperature is lowered by expansion to a temperature T9 lower than T8, the first refrigerant gas stream as formed in this way being reinjected into the main cryogenic heat exchanger in order to contribute to cooling the main natural gas stream and the initial refrigerant gas stream; and at the outlet from the main cryogenic heat exchanger, the first refrigerant gas stream, which is at a temperature T10 close to the temperature of the hot source, is directed to a compressor driven by the low temperature expansion turbine in order to be compressed therein prior to being cooled and then directed to the suction of the refrigerant gas compressor.

The liquefaction process of the invention comprises two semi-open refrigerant cycles with natural gas and a single closed refrigerant cycle with refrigerant gas. The first semi-open refrigerant cycle with natural gas serves to extract the heavy natural gas liquids (NGL) that might be present in the natural gas so as to avoid problems of freezing in the cold section of the liquefaction installation, and so as to pre-cool the natural gas and the refrigerant gas. The second semi-open refrigerant cycle with natural gas serves to contribute to pre-cooling the natural gas and the refrigerant gas and also to liquefying the natural gas. The closed refrigerant cycle with refrigerant gas serves to subcool the liquefied natural gas and to provide refrigeration power in addition to the other two cycles. The refrigerant gas used is typically nitrogen.

It has been calculated that the process of the invention presents a ratio of mechanical power consumed per tonne of LNG produced under equivalent conditions that is about 15% lower than a two refrigerant cycle process with nitrogen, 10% lower than a three refrigerant cycle process with nitrogen, and 8% lower than a process having one refrigerant cycle with natural gas and two refrigerant cycles with nitrogen when those processes are associated with an NGL extraction unit upstream from the liquefaction, making recompression of the gas necessary (this recompression power being taken into account in the comparison). The power consumed per tonne of LNG produced by the process of the invention is thus lower than by the processes known in the prior art, thereby demonstrating higher efficiency for this process.

The process of the invention integrates extracting heavy natural gas liquids (NGLs) with liquefaction, thereby improving the overall energy efficiency of the natural gas liquefaction plant and making it possible to avoid having recourse to installations that are dedicated to such extraction. The natural gas pre-treatment process is thus simplified. Furthermore, since the extraction is performed at low pressure, few light hydrocarbons (in particular methane) are entrained during the extraction process, thereby making it possible to treat heavy NGLs by using a process that is simple to implement.

The single cycle with refrigerant gas in the process of the invention is a closed cycle. Thus, only top-up refrigerant gas is needed, and it can easily be produced (specifically when the refrigerant gas is predominantly nitrogen). In particular, no dedicated unit is required for importing, producing, treating, or storing liquid hydrocarbons for use as refrigerant. This makes the process of the invention much easier to install.

The process of the present invention presents a high level of intrinsic safety. Specifically, the masses of hydrocarbons involved are limited (in particular compared with a process using hydrocarbons in liquid form as refrigerants). This makes the process of the invention easier to install.

Finally, the process is particularly suitable for an offshore installation for natural gas liquefaction, e.g. such as on board an FLNG, because of its high level of intrinsic safety and because it does not require refrigerants to be stored.

In a "series recompression" variant, during the second semi-open refrigerant cycle with natural gas, the natural gas stream at the outlet from the compressor driven by the intermediate expansion turbine is cooled and then mixed with the first natural gas stream prior to being directed to the inlet of the compressor driven by the ambient temperature expansion turbine. This variant makes it possible to perform staged compression of the natural gas so as to make the compression more efficient.

In an "additional pre-cooling by auxiliary refrigerant cycle" variant, during the first semi-open refrigerant cycle with natural gas, the feed stream of natural gas at the admission to the ambient temperature expansion turbine is further cooled in an auxiliary heat exchanger. In this variant, an auxiliary refrigeration cycle delivers the refrigeration power needed for the operation of the auxiliary heat exchanger. This arrangement results in the temperature in the main separator being lowered, thereby serving to obtain better recovery of NGLs.

In an "NGL absorption by subcooled reflux" variant, during the second semi-open refrigerant cycle with natural gas, the third natural gas stream at the exhaust from the intermediate expansion turbine is directed to an auxiliary separator from the outlet of which the natural gas stream is reinjected into the main cryogenic heat exchanger, the natural gas liquid stream at the outlet from the auxiliary separator being pumped in full or in part to the main separator in order to contribute to absorbing natural gas liquids. Contact between the natural gas for treatment and the subcooled reflux may for example take place in counter-current. For this purpose, the main separator may be fitted with a packing bed. In this variant, it is easy to treat light gases with a high content of aromatic compounds (e.g. benzene) or to extract LPGs at a high recovery rate (e.g. in order to provide industrial production of the LPGs).

In a "NGL absorption by LNG reflux" variant, during the first semi-open refrigerant cycle with natural gas a portion of the fraction of the main natural gas stream that passes through the main cryogenic heat exchanger in order to be cooled therein is extracted from said main cryogenic heat exchanger at a temperature T11 higher than the temperature T3 in order to be directed to the main separator so as to contribute to absorbing natural gas liquids. Contact between the natural gas for treatment and the LNG reflux may for example take place in counter-current. For this purpose, the main separator may be provided with a packing bed. In this variant, it is possible to treat light gases with a content of aromatic compounds (e.g. benzene) or in particular to extract LPGs at a high recovery rate, and also ethane.

During the first semi-open refrigerant cycle with natural gas, the natural gas feed stream is advantageously mixed with the lighter natural gas coming from the delivery of the natural gas compressor before being expanded in the ambient temperature turbine without pre-cooling in the main cryogenic heat exchanger, thus making it possible to produce efficiently a cold gas for pre-cooling the natural gas and the refrigerant gas and to extract any NGLs with excellent selectivity.

During the first semi-open refrigerant cycle with natural gas, the natural gas feed stream at the exhaust from the ambient temperature expansion turbine is injected into the main separator, from the outlet of which a liquid stream of heavy gases is recovered. Under such circumstances, a fraction of the recovered natural gas liquid stream is heated and vaporized in part in order to facilitate its treatment downstream.

In an advantageous provision, the pressure of the main natural gas stream is higher than the critical pressure of the natural gas, thereby serving to maximize the efficiency of liquefaction and ensuring that liquefaction takes place without change of phase.

The invention also provides a natural gas liquefaction installation for performing a process as defined above, the installation comprising an ambient temperature expansion turbine for receiving a natural gas feed stream and a portion of a second natural gas stream coming from the delivery of a natural gas compressor and having an exhaust connected to an inlet of a main separator, a main cryogenic heat exchanger for receiving the natural gas and refrigerant gas streams, a compressor driven by the ambient temperature expansion turbine for receiving a first natural gas stream from the main separator and having an outlet connected to the suction of the natural gas compressor, an intermediate temperature expansion turbine for receiving a portion of a main natural gas stream coming from the delivery of the natural gas compressor and connected to the inlet and to the outlet of the main cryogenic heat exchanger, a compressor driven by the intermediate temperature expansion turbine to receive a third natural gas stream from the main cryogenic heat exchanger, a low temperature expansion turbine for the refrigerant gas connected to the inlet and the outlet of the main cryogenic heat exchanger, and a compressor driven by the low temperature expansion turbine and having an outlet connected to the suction of a refrigerant gas compressor.

Preferably, the natural gas compressor and the refrigerant gas compressor are driven by the same driver machine delivering the mechanical power needed to increase the pressure of the natural gas for liquefying and for compressing the fluids flowing in the three refrigerant cycles. The consumption of mechanical power needed for these functions is thus optimized in such as a manner as to maximize the production of LNG while minimizing the amount of equipment.

Also preferably, the natural gas compressor is downstream from the compressors driven by the ambient temperature expansion turbine and the intermediate temperature expansion turbine, and the refrigerant gas compressor is downstream from the compressor driven by the low temperature expansion turbine.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF THE INVENTION

The liquefaction process of the invention applies particularly (but not exclusively) to natural gas coming from a gas field. Typically, the natural gas comprises predominantly methane which is to be found in combination with other gases, mainly C2, C3, C4, C5, and C6 hydrocarbons, acid gases, water, and inert gases including nitrogen, together with various impurities such as mercury.

Figure 1:
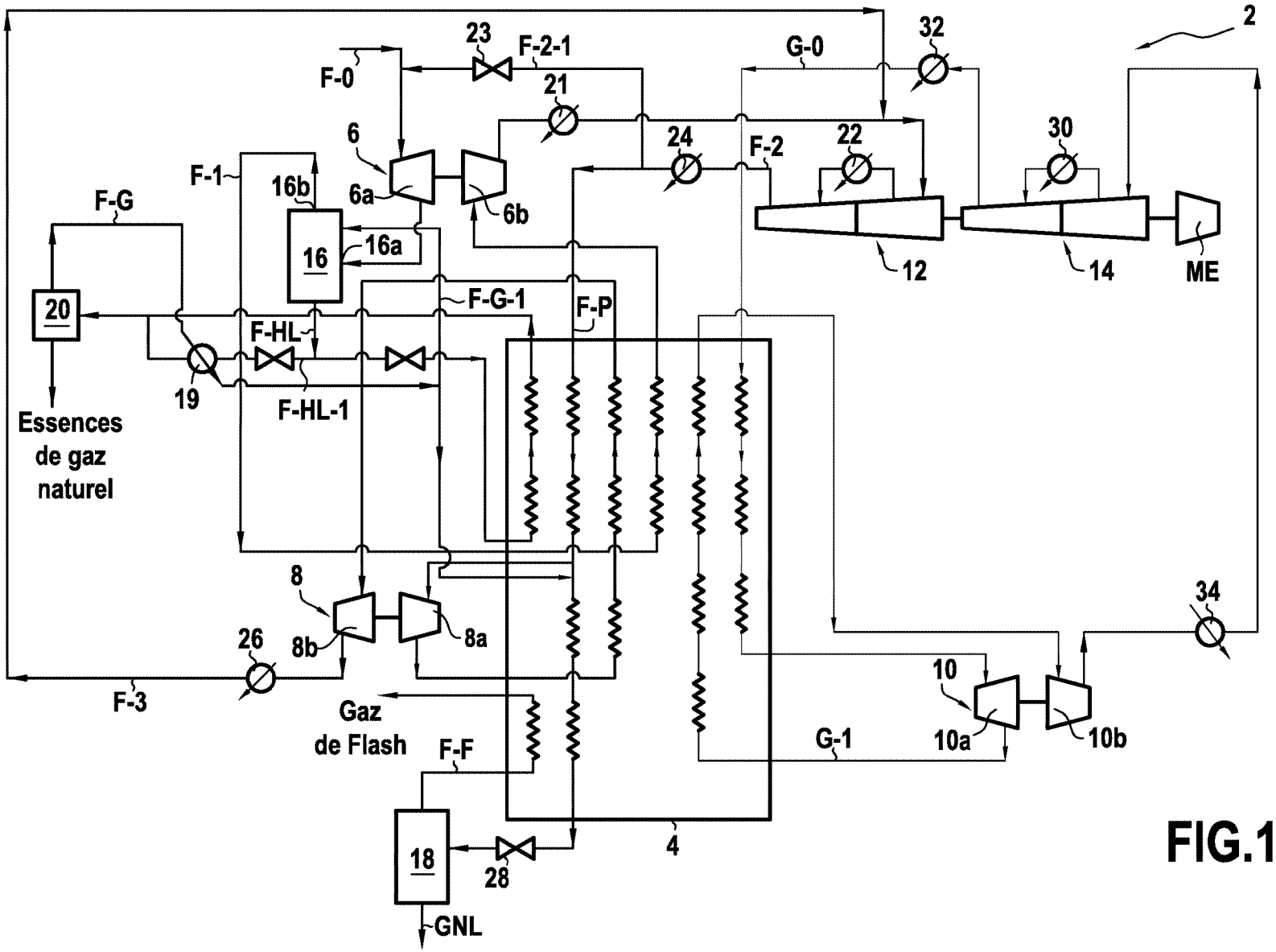
FIG. 1 is a diagram showing an implementation of the liquefaction process of the invention.

FIG. 1 shows an example installation 2 for performing the natural gas liquefaction process of the invention.

In substance, the liquefaction process of the invention has recourse to three thermodynamic refrigeration cycles, namely two semi-open refrigerant cycles with natural gas and one closed refrigerant cycle with refrigerant gas.

Furthermore, the process of the invention preferably uses as its refrigerant gas a gas that comprises predominantly nitrogen, thereby making the process particularly suitable for performing off-shore, typically on a floating liquefaction of natural gas (FLNG) installation.

As shown in FIG. 1, the liquefaction installation 2 requires only one main cryogenic heat exchanger 4, which may be made up of a set of brazed aluminum heat exchangers installed in a cold box.

The liquefaction installation 2 of the invention also requires three turboexpanders, namely an ambient temperature turboexpander 6 dedicated to natural gas, an intermediate temperature turboexpander 8 dedicated to natural gas, and a low temperature turboexpander 10 dedicated to the refrigerant gas.

In known manner, a turboexpander is a rotary machine made up of a gas expansion turbine (in this example respectively an ambient temperature expansion turbine 6*a*, an intermediate temperature expansion turbine 8*a*, and a low temperature expansion turbine 10*a*) together with a gas compressor (specifically respectively a compressor 6*b*, a compressor 8*b*, and a compressor 10*b*) driven by the gas expansion turbine.

The liquefaction installation 2 of the invention further comprises a natural gas compressor 12 and a refrigerant gas compressor 14, these two compressors 12 and 14 preferably being driven by a common driver machine ME, e.g. a gas turbine delivering the power needed for increasing the pressure of the natural gas for liquefying and also for compressing the fluids flowing in all three refrigerant cycles.

As described in detail below, the natural gas compressor performs three functions: pressurizing and causing natural gas to flow so as to deliver sufficient refrigeration power for contributing to the refrigeration and the liquefaction of the natural gas and of the refrigerant gas; recompressing the natural gas that was expanded so as to extract heavy NGLs; and ensuring that the natural gas for liquefying is at the optimum pressure for maximizing the efficiency of the liquefaction.

The function of the refrigerant compressor is to pressurize and circulate the refrigerant gas so as to obtain the refrigeration needed for contributing to cooling the refrigerant gas, contributing to pre-cooling and liquefying the natural gas, and ensuring subcooling of the natural gas.

The liquefaction installation 2 also has a main separator 16 for separating any NGLs contained in the natural gas, and a drum 18 for separating the final flash gases and the liquefied natural gas (LNG).

There follows a description of the various steps of the natural gas liquefaction process of the invention.

Prior to the first semi-open refrigerant cycle with natural gas, the natural gas is subjected to pre-treatment so as to make it suitable for liquefaction. This pre-treatment comprises in particular treatment for extracting acid gases (including carbon dioxide) from the natural gas, which acid gases may in particular freeze in the liquefaction installation. The pre-treatment also comprises dehydration treatment for extracting water from the natural gas and mercury removal treatment, where mercury runs the risk of degrading equipment made of aluminum in the liquefaction installation (including the main cryogenic heat exchanger 4).

The feed stream F-0 of natural gas leaves this prior pre-treatment stage typically at a pressure P0 in the range 5 MPa to 10 MPa and at a temperature T0 that is close (specifically in this example slightly higher than) the temperature of the hot source. The term "hot source" is used herein to mean the heat source that is used for cooling the non-cryogenic streams of the liquefaction process. The hot source may typically be ambient air, sea water, fresh water cooled by sea water, a fluid cooled by an auxiliary refrigerant cycle, or a combination of a plurality of these sources.

This stream F-0 is mixed with the natural gas stream F-2-1 coming from the liquefaction installation (and described below) and it feeds the first semi-open refrigerant cycle with natural gas.

As mentioned above, this first semi-open refrigerant cycle with natural gas serves to extract any heavy NGLs that may be present in the natural gas, and to pre-cool the natural gas and the refrigerant gas.

For this purpose, the natural gas feed stream F-0 (combined with the natural gas stream F-2-1 as described below) passes through the expansion turbine at ambient temperature 6*a* at the exhaust (i.e. at the outlet) of which the pressure P1 is lowered to a pressure lying in the range 1 MPa to 3 MPa and its temperature T1 is lowered to a temperature lying in the range −40° C. to −60° C. This stage of expanding the natural gas feed stream leads to condensation of any heavy NGLs contained in the natural gas.

The term "heavy NGLs" is used herein to mean essentially C5 (pentanes), C6 (hexanes, benzene), and higher hydrocarbons that are contained in the natural gas, and also smaller and varying fractions of ethane, of propane, and of butanes, and a very limited fraction of methane.

With the condensation of heavy NGLs, the natural gas stream at the exhaust from the ambient temperature expansion turbine 6*a* is directed to the inlet of the main separator 16. At the outlet from the main separator 16, the stream F-HL of natural gas liquids is heated, e.g. by flowing through the main cryogenic heat exchanger 4 (as shown in the figure) or by passing through a dedicated NGL reboiler, and it is then directed to an NGL treatment unit 20. After being heated, the stream F-HL of natural gas liquids is a two-phase stream and it may either be sent directly to the NGL treatment unit 20 (as shown in the figure) or else it may be subjected to gas-liquid separation, with the evaporated gas being returned to the main separator 16.

The NGL treatment unit 20 is a unit for treating heavy NGLs, and in particular for separating butanes and lighter hydrocarbons from pentanes and heavier hydrocarbons so as to form an outlet stream of light natural gas liquids F-G (also referred to as the light NGL stream F-G), and a natural gas gasoline stream. At the outlet from the NGL treatment unit, the light NGL stream F-G which predominantly comprises ethane, propane, and butanes is for reinjection into the gas for liquefying wherever that is compatible with the specification for the target LNG (or else it is used away from the liquefaction installation, wherever that is not compatible).

Furthermore, a fraction F-HL-1 of the heavy natural gas liquid stream F-HL may be directed to an NGL cooler 19 to deliver the heat power needed for operating the heat exchanger. In particular, the light natural gas liquid stream F-G from the NGL treatment unit 20 is cooled in the NGL cooler 19. A fraction F-G-1 of the cooled light NGL stream F-G is reinjected into the main separator 16.

By controlling the rate at which this stream F-G-1 is reinjected into the main separator, it is thus possible to improve the extraction of heavy NGLs and in particular to reduce the residual quantity of benzene and of heavy hydrocarbons in the gas at the outlet from the main separator.

The fraction of the cooled light NGL stream F-G that is not reinjected into the main separator 16 is reinjected into the main natural gas stream F-P downstream from the takeoff point feeding the intermediate temperature turbine 8*a* (described below).

It should be observed that reinjecting the faction F-G-1 of the cooled light NGL stream F-G into the main separator 16 is not necessary if the quantities of benzene and of C5 and higher hydrocarbons in the natural gas feed stream are low. It should also be observed that cooling the light NGL stream F-G may be performed directly in the main cryogenic heat exchanger 4 if no dedicated heat exchanger for that purpose is provided.

Finally, it should be observed that injecting the light NGL stream F-G may take place either in co-current or else in counter-current. When the light NGL stream F-G is reinjected in counter-current into the main separator 16, it may optionally be fitted with a packing bed in order to improve the efficiency of NGL extraction.

At the outlet from the main separator 16, the natural gas stream minus the heavy hydrocarbons (gas residue) is at a temperature that is acceptable for pre-cooling both the gas for liquefying and the refrigerant gas. For this purpose, this gas residue forms a first natural gas stream F-1 that passes through the main cryogenic heat exchanger.

When it passes through the main cryogenic heat exchanger, the first natural gas stream F-1 exchanges heat to cool firstly a main natural gas stream F-P flowing in counter-flow through the main cryogenic heat exchanger, and secondly the initial refrigerant gas stream G-0 (as mentioned below) flowing in counter-flow through the main cryogenic heat exchanger.

At the outlet from the main cryogenic heat exchanger, the first natural gas stream F-1 is at a temperature T2 higher than T1 and close to the temperature of the hot source. It is sent to the compressor 6*b* that is driven by the ambient temperature expansion turbine 6*a* where it is compressed to a pressure P2, typically lying in the range 2 MPa to 4 MPa.

At the delivery (i.e. at the outlet) of the compressor 6*b*, the natural gas stream passes through a natural gas cooler 21 and is then admitted into the suction (i.e. the inlet) of the natural gas compressor 12 where it is further compressed to a pressure P3 higher than P2 and P0 (and preferably higher than the critical pressure of the natural gas) so as to form at the outlet a second natural gas stream F-2. Typically, the pressure P3 may lie in the range 6 MPa to 10 MPa.

In this natural gas compressor 12, the natural gas stream may be compressed in two successive compression stages, between which the natural gas stream may be cooled by a natural gas cooler 22.

The second natural gas stream F-2 passes through another natural gas cooler 24 and is then separated into two stream fractions: one stream fraction F-2-1 is expanded and mixed with the natural gas feed stream F-0 upstream from the ambient temperature expansion turbine 6*a* (as described above), and the remaining fraction of this stream forms the main natural gas stream F-P that passes through the main cryogenic heat exchanger 4.

It should be observed that the stream F-2-1 may be expanded either merely by means of a control valve 23 (as shown in the figure), or else by means of an expansion turbine.

A fraction of this main natural gas stream F-P passes through the main cryogenic heat exchanger where it is cooled to a temperature T3 (typically lying in the range −140° C. to −160° C.) that is low enough to liquefy natural gas.

Another fraction of the main natural gas stream F-P is subjected to a second natural gas semi-open cycle. The purpose of this second cycle is to contribute to cooling the refrigerant gas and to contribute to pre-cooling the natural gas and to liquefying it.

The fraction of the main natural gas stream F-P that is subjected to this second semi-open cycle is extracted from the main cryogenic heat exchanger at a temperature T4 (typically lying in the range −10° C. to −40° C.) that is higher than the temperature T3 in order to be sent to the intermediate temperature expansion turbine 8*a* so as to lower its temperature by expansion to a temperature T5 (typically lying in the range −80° C. to −110° C.) that is lower than the temperature T4 so as to form a third natural gas stream F-3.

The third natural gas stream F-3 may optionally contain a varying fraction of condensed liquid and it is then reinjected into the main cryogenic heat exchanger in order to exchange heat so as to cool the initial refrigerant gas stream G-0 and the main natural gas stream F-P passing through the main cryogenic heat exchanger in counter-current.

At the outlet from the main cryogenic heat exchanger, the third natural gas stream F-3 in the gas phase and at a temperature T6 close to the temperature of the hot source is directed to a compressor 8*b* that is driven by the intermediate temperature expansion turbine 8*a*, where it is compressed. It is then cooled by a natural gas cooler 26 prior to being mixed with the first natural gas stream F-1 upstream from the natural gas compressor 12.

On passing through the main cryogenic heat exchanger, the main natural gas stream F-P is cooled by heat exchange with the first natural gas stream F-1, the third natural gas stream F3, and by a first refrigerant gas stream G-1 (described below) all three of which flow as counter-currents through the main cryogenic heat exchanger 4.

At the outlet from the main cryogenic heat exchanger, the main natural gas stream F-P has thus been cooled to a temperature enabling it to liquefy. It is subjected to Joule-Thomson expansion on passing through a valve 28 so as to reach a pressure close to atmospheric pressure. Alternatively, this expansion could be performed by means of a liquid expansion turbine in order to improve its efficiency.

Expanding the liquefied natural gas has the effect of generating flash gases, which are separated from the liquefied natural gas in the drum 18 that is dedicated to this purpose. At the outlet from the drum, the liquefied natural gas (LNG) stream separated from the flash gases is delivered to LNG storage vessels.

The flash gases F-F are sent to the main cryogenic heat exchanger in order to be heated to a temperature T11 typically lying in the range −50° C. to −110° C., and then to a flash gas treatment unit, thus making it possible to reduce the refrigeration power requirements in the cold section of the main cryogenic heat exchanger.

There follows a description of the sole closed refrigerant cycle, which uses the refrigerant gas (predominantly nitrogen in this example) for the purpose of delivering additional thermal power to the other two refrigerant cycles and for subcooling the liquefied natural gas.

The refrigerant gas compressor 14 delivers an initial refrigerant gas stream G-0 that, after being cooled in a refrigerant gas cooler 32, is at a temperature T7 close to the temperature of the hot source.

Most of this initial refrigerant gas stream G-0 is caused to flow through the main cryogenic heat exchanger 4 in order to be pre-cooled by heating the first natural gas stream F-1, a third natural gas stream F-3, and also the first refrigerant gas stream G-1 as mentioned below, which flows in counter-current through the main cryogenic heat exchanger.

At the outlet from the main cryogenic heat exchanger, the initial refrigerant gas stream G-0 is at a temperature T8 (e.g. lying in the range −80° C. to −110° C.) that is lower than the temperature T7. This stream is directed to the low temperature expansion turbine 10*a* in order to be further cooled down to a temperature T9 (e.g. lying in the range −140° C. to −160° C.) that is lower than the temperature T8, prior to being reinjected into the main cryogenic heat exchanger in order to form a first refrigerant gas stream G-1.

As described above, the flow of this first refrigerant gas stream G-1 through the main cryogenic heat exchanger exchanges heat so as to cool the main natural gas stream F-P and the initial refrigerant gas stream G-0 in counter-current flows through the main cryogenic heat exchanger.

At the outlet from the main cryogenic heat exchanger 4, the first refrigerant gas stream G-1 is at a temperature T10 higher than T9 and close to the temperature of the hot source. This stream is directed to the compressor 10*b* driven by the low temperature expansion turbine 10*a* in order to be compressed prior to being cooled by a refrigerant gas cooler 34 and then reinjected as suction into the refrigerant gas compressor 14.

It should be observed that in the refrigerant gas compressor 14, the first refrigerant stream G-1 may be compressed in two successive compression stages with the refrigerant gas stream possibly being cooled between them by means of another refrigerant gas cooler 30.

With reference to FIGS. 2 to 5, several variants of the liquefaction process of the invention are described below, it being observed that each of these variants can be implemented separately or in combination with the others depending on circumstances.

Figure 2:
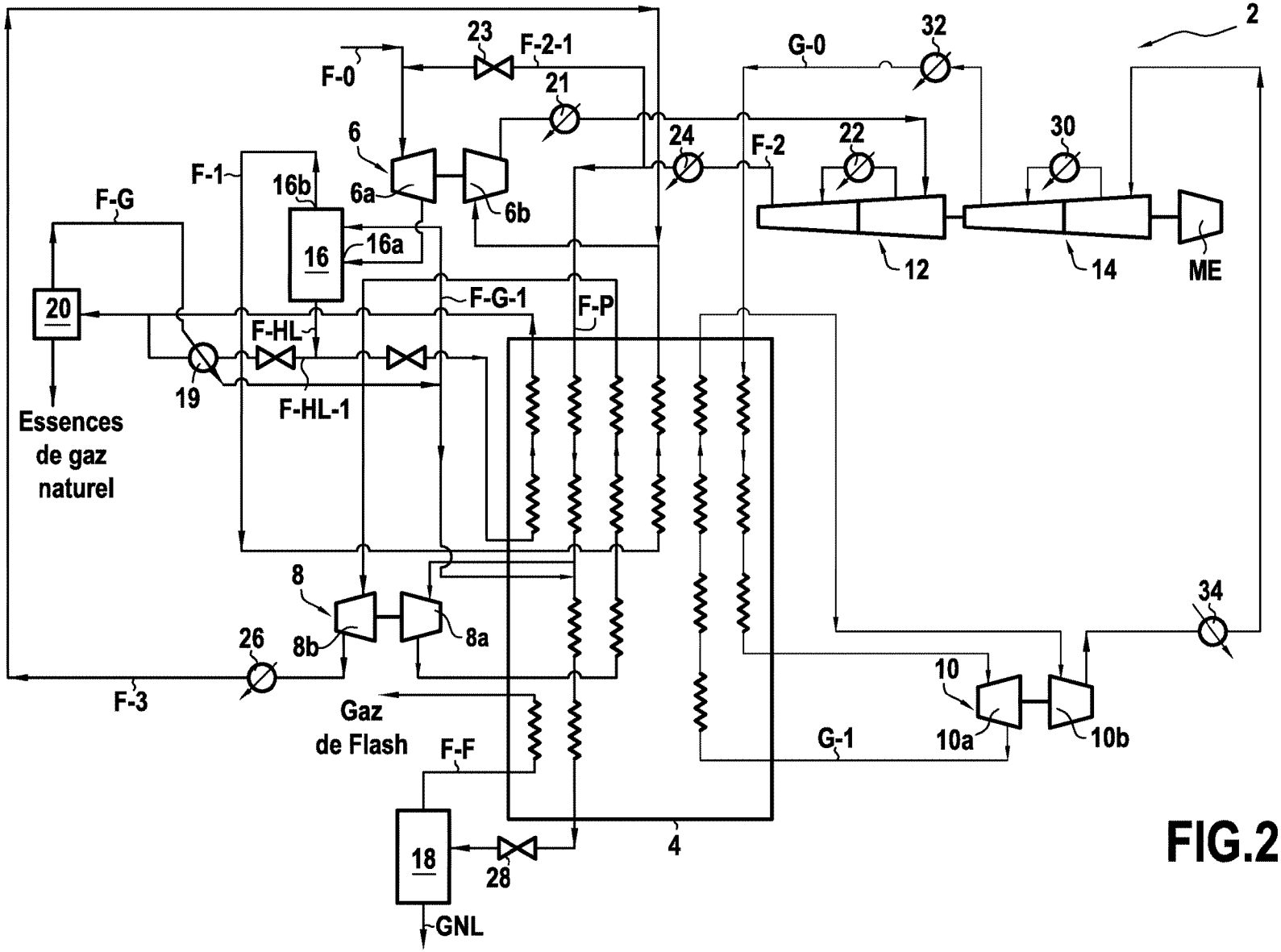
FIG. 2 shows a variant implementation of the liquefaction process of the invention referred to as the "series recompression" variant.

FIG. 2 shows a variant liquefaction process of the invention referred to as the "series recompression" variant.

This variant differs from the embodiment of FIG. 1 in that the flow delivered by the compressor 8*b* driven by the intermediate temperature expansion turbine 8*a* is directed to the suction of the compressor 6*b* driven by the ambient temperature expansion turbine 6*a* (instead of being admitted directly to the suction of the natural gas compressor 12 as described for the embodiment of FIG. 1). At the delivery from the compressor 6*b*, this natural gas flow passes through the natural gas compressor 21 and is then admitted to the suction of the natural gas compressor.

This variant thus enables the natural gas to be compressed in stages, which is more efficient than the compression described with reference to FIG. 1.

Figure 3:
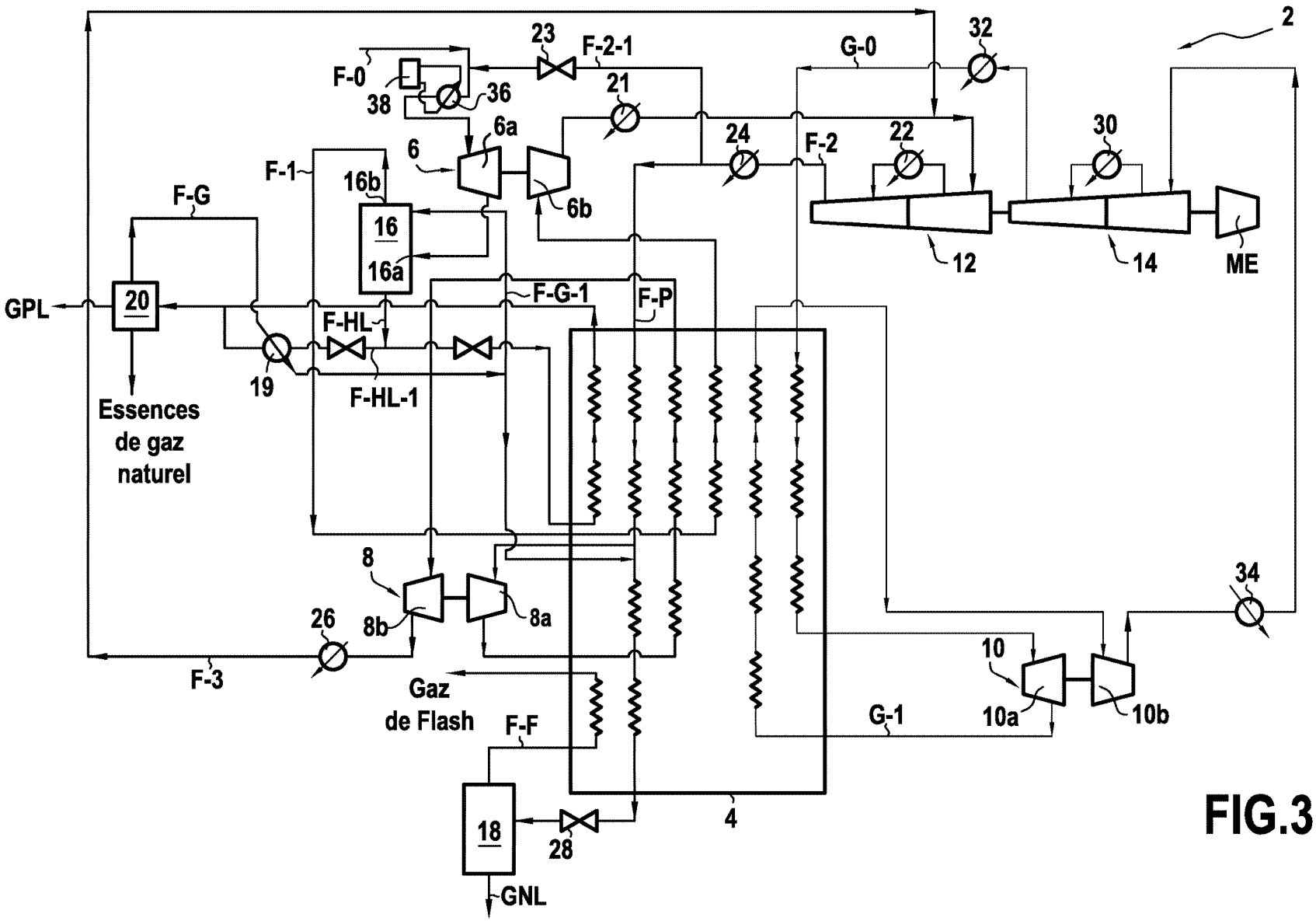
FIG. 3 shows another variant implementation of the liquefaction process of the invention referred to as the "additional pre-cooling by an auxiliary refrigerant cycle" variant.

FIG. 3 shows another variant of the liquefaction process of the invention referred to as the "additional pre-cooling by auxiliary refrigerant cycle" variant.

This variant differs from the embodiment of FIG. 1 in that during the first semi-open refrigerant cycle with natural gas, the natural gas feed stream at the admission to the ambient temperature expansion turbine 6*a* is cooled additionally in an auxiliary heat exchanger 36.

As shown in FIG. 3, an auxiliary refrigeration cycle 38 delivers the refrigeration power needed to operate the auxiliary heat exchanger 36. This cycle may for example be a hydrofluorocarbon (HFC) cycle or a carbon dioxide cycle.

In this variant, the temperature in the main separator 16 is lowered, thus making it possible to obtain better recovery of NGLs.

Figure 4:
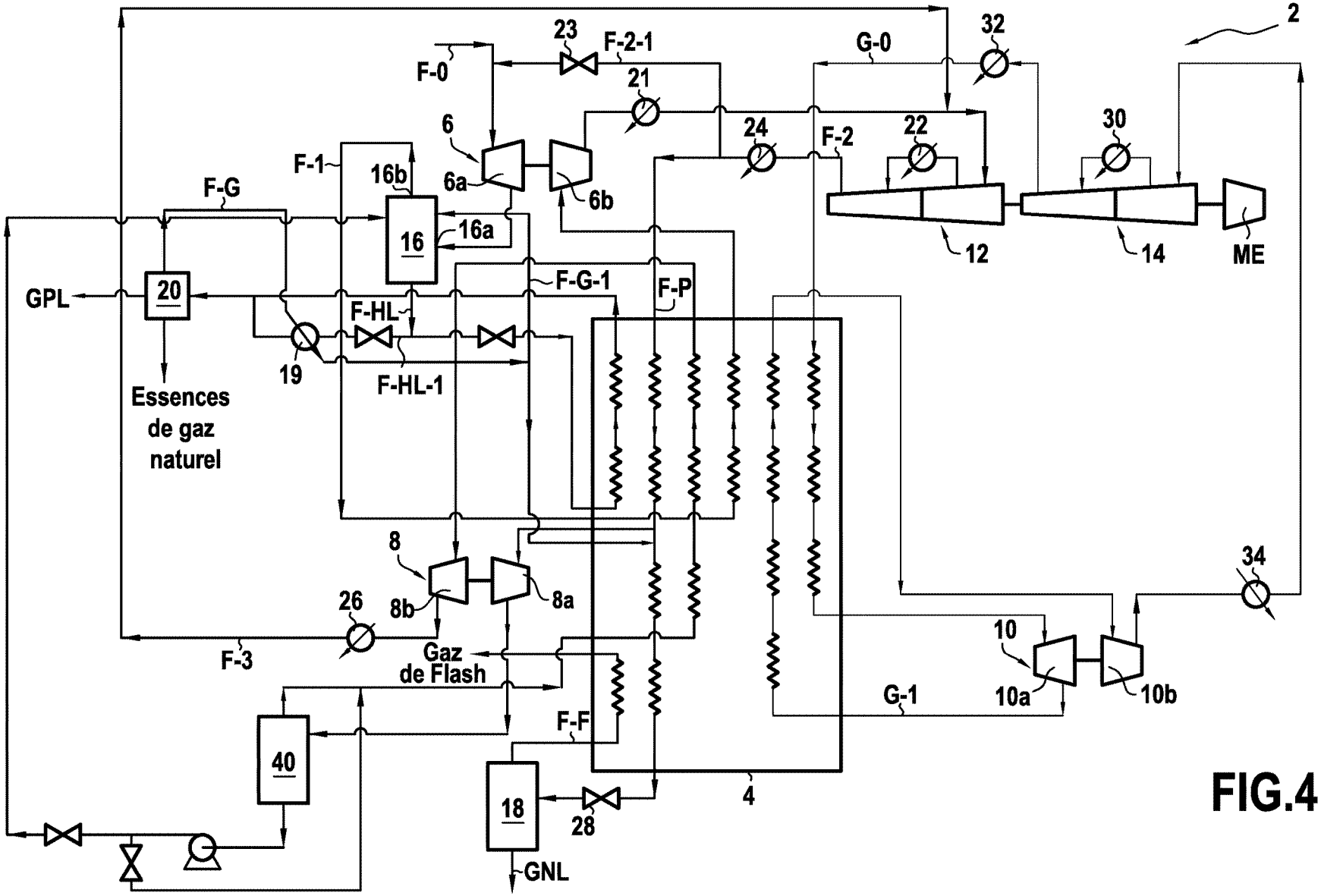
FIG. 4 shows another variant implementation of the liquefaction process of the invention referred to as the "absorption of NGL by under-cooled reflux" variant.

FIG. 4 shows another variant of the liquefaction process of the invention referred to as the "NGL absorption by subcooled reflux" variant.

In this variant, during the second semi-open refrigerant cycle with natural gas, the third natural gas stream F-3 at the exhaust from the intermediate expansion turbine 8*a* is directed to an auxiliary separator 40 from the outlet of which the natural gas stream is reinjected into the main cryogenic heat exchanger 4, the stream of natural gas liquids at the outlet from the auxiliary separator 40 being pumped in full or in part to the main separator 16 in order to contribute to absorbing liquids of the natural gas.

Contact between the natural gas for treatment and the subcooled reflux may take place in counter-current. For this purpose, the main separator may be fitted with a packing bed, for example. In this variant, it is possible to treat light gases with a high content of aromatic compounds (e.g. benzene), or to extract LPGs with a high recovery rate (e.g. in order to ensure industrial production of LPGs).

Figure 5:
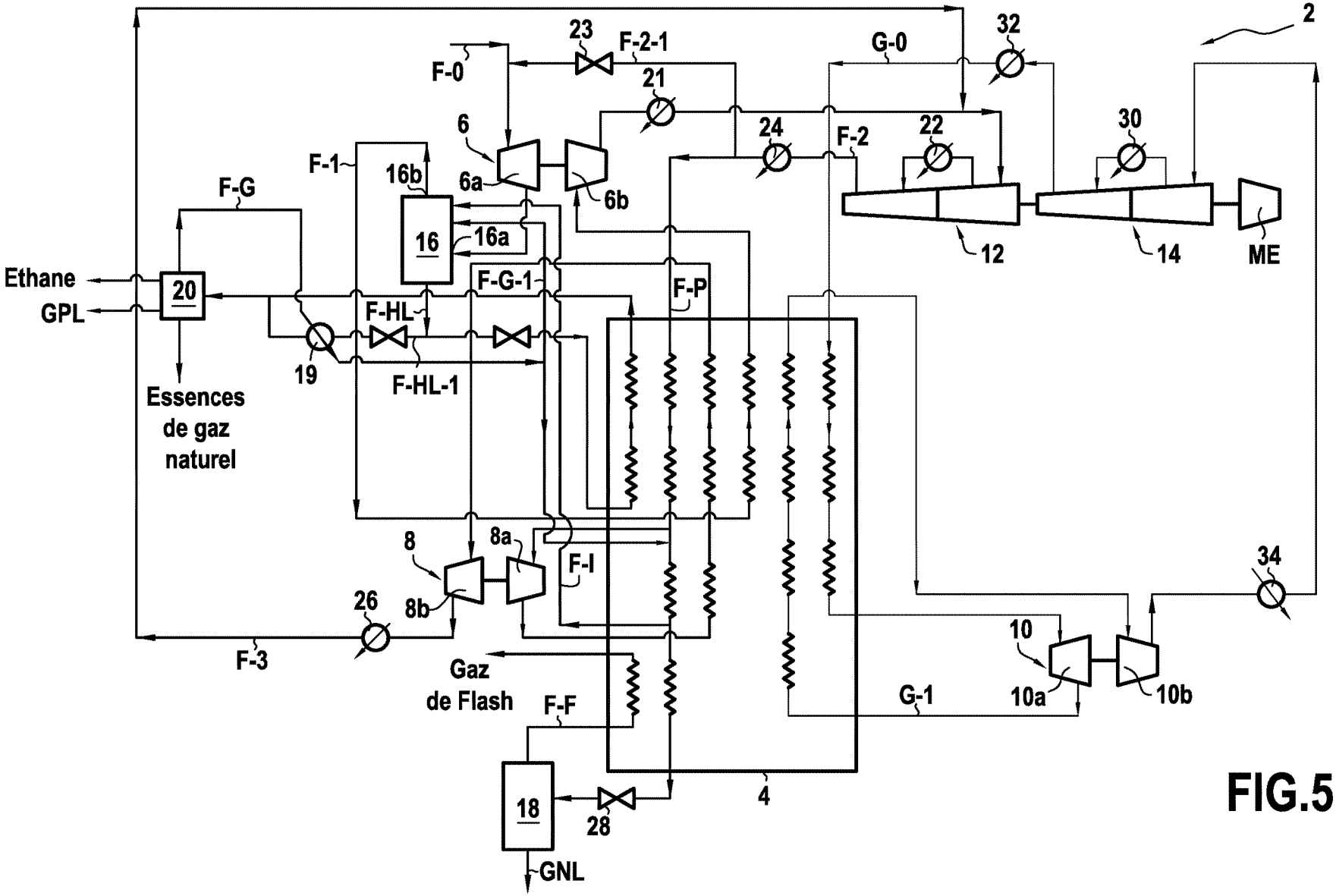
FIG. 5 shows another variant implementation of the liquefaction process of the invention referred to as the "absorption of NGL by LNG reflux" variant.

FIG. 5 shows another variant of the liquefaction process of the invention referred to as the "NGL absorption by LNG reflux" variant.

In this variant, during the first semi-open refrigerant cycle with natural gas, a portion F-I of the fraction of the main natural gas stream F-P that passes through the main cryogenic heat exchanger 4 where it is cooled, is extracted from said main cryogenic heat exchanger at a temperature T11 in order to be directed to the main separator 16 so as to contribute to absorbing natural gas liquids.

The temperature T11 at which the stream F-I is extracted is higher than the temperature T3. By way of example, it lies in the range −70° C. to −110° C.

Contact between the natural gas for treatment and the LNG reflux may for example take place in counter-current. For this purpose, the main separator may for example be fitted with a packing bed. In this variant, it is possible to treat light gases with a high content of aromatic compounds of aromatic compounds (e.g. benzene) or in particular to extract LPGs at a high recovery rate together with ethane.

The invention claimed is:

1. A process for liquefying a natural gas comprising a mixture of hydrocarbons predominating in methane, the process comprising:

a) a first semi-open refrigerant cycle with natural gas in which in succession:

a natural gas feed stream (F-0) at a pressure P0 previously treated to extract acid gases, water, and mercury therefrom is mixed with a natural gas stream, expanded to a pressure P1, and its temperature lowered to a temperature T1 by means of an ambient temperature expansion turbine so as to obtain condensation of any natural gas liquids contained in the natural gas;

any natural gas liquids that have condensed are separated in a main separator from the natural gas feed stream, the stream then passing through a main cryogenic heat exchanger in order to form a first natural gas stream (F-1) contributing by heat exchange firstly to pre-cooling a main natural gas stream (F-P) flowing in counter-current through the main cryogenic heat exchanger, and secondly to cool an initial refrigerant gas stream (G-0) flowing in counter-current through the main cryogenic heat exchanger;

at the outlet from the main cryogenic heat exchanger, the first natural gas stream (F-1), which is at a temperature T2 higher than T1, is compressed to a pressure P2 by means of a compressor driven by the ambient temperature expansion turbine prior to being admitted to the suction of a natural gas compressor in order to be further compressed therein to a pressure P3 higher than P2 so as to form a second natural gas stream (F-2);

the second natural gas stream (F-2) at the delivery from the natural gas compressor is in part expanded and mixed with the natural gas feed stream (F-0) upstream from the ambient temperature expansion turbine, and in part forms the main natural gas stream (F-P); and a fraction of this main natural gas stream (F-P) passes through the main cryogenic heat exchanger in order to be cooled therein to a temperature T3 that is low enough to enable the natural gas to liquefy;

b) a second semi-open refrigerant cycle with natural gas in which, in succession:

another fraction of the main natural gas stream (F-P) is extracted from the main cryogenic heat exchanger at a temperature T4 higher than T3 in order to be directed to an intermediate expansion turbine so that its temperature is lowered by expansion to a temperature T5 lower than T4 and so as to form a third natural gas stream (F-3);

the third natural gas stream (F-3) is reinjected into the main cryogenic heat exchanger in order to exchange heat so as to cool the main natural gas stream and the initial refrigerant gas stream flowing in countercurrent through the main cryogenic heat exchanger; and at the outlet from the main cryogenic heat exchanger, the third natural gas stream (F-3), which is at a temperature T6 close to the temperature of the hot source, is directed to a compressor driven by the intermediate expansion turbine in order to be compressed therein and it is then cooled prior to being mixed with the first natural gas stream upstream from the natural gas compressor; and c) a closed refrigerant cycle with refrigerant gas in which, in succession:

an initial refrigerant gas stream (G-0) at a temperature T7 and previously compressed by a refrigerant gas compressor is caused to flow through the main cryogenic heat exchanger in order to be re-cooled therein;

at the outlet from the main cryogenic heat exchanger, the initial refrigerant gas stream (G-0), which is at a temperature T8 lower than T7, is directed to a low temperature expansion turbine so that its temperature is lowered by expansion to a temperature T9 lower than T8, the first refrigerant gas stream (G-1) as formed in this way being reinjected into the main cryogenic heat exchanger in order to contribute to cooling the main natural gas stream (F-P) and the initial refrigerant gas stream (G-0); and at the outlet from the main cryogenic heat exchanger, the first refrigerant gas stream (G-1), which is at a temperature T10, is directed to a compressor driven by the low temperature expansion turbine in order to be compressed therein prior to being cooled and then directed to the suction of the refrigerant gas compressor.

2. The process according to claim 1, wherein, during the second semi-open refrigerant cycle with natural gas, the natural gas stream at the outlet from the compressor driven by the intermediate expansion turbine is cooled and then mixed with the first natural gas stream prior to being directed to the inlet of the compressor driven by the ambient temperature expansion turbine.

3. The process according to claim 1, wherein, during the first semi-open refrigerant cycle with natural gas, the feed stream of natural gas at the admission to the ambient temperature expansion turbine is further cooled in an auxiliary heat exchanger.

4. The process according to claim 1, wherein, during the second semi-open refrigerant cycle with natural gas, the third natural gas stream (F-3) at the exhaust from the intermediate expansion turbine is directed to an auxiliary separator from the outlet of which the natural gas stream is reinjected into the main cryogenic heat exchanger, the natural gas liquid stream at the outlet from the auxiliary separator being pumped in full or in part to the main separator in order to contribute to absorbing natural gas liquids.

5. The process according to claim 1, wherein, during the first semi-open refrigerant cycle with natural gas a portion of the fraction of the main natural gas stream (F-P) that passes through the main cryogenic heat exchanger in order to be cooled therein is extracted from said main cryogenic heat exchanger at a temperature T11 higher than the temperature T3 in order to be directed to the main separator so as to contribute to absorbing natural gas liquids.

6. The process according to claim 1, wherein, during the first semi-open refrigerant cycle with natural gas, the natural gas feed stream (F-0) is expanded and its temperature lowered by means of the ambient temperature expansion turbine without being subjected to prior pre-cooling in the main cryogenic heat exchanger.

7. The process according to claim 1, wherein, during the first semi-open refrigerant cycle with natural gas, the natural gas feed stream at the exhaust from the ambient temperature expansion turbine is injected into the main separator, from the outlet of which a stream of natural gas liquids (F-HL) is recovered.

8. The process according to claim 7, wherein the recovered natural gas liquid stream (F-HL) is heated and vaporized in part in order to facilitate its treatment downstream.

9. The process according to claim 7, wherein the heat power needed to heat the natural gas liquid stream (F-HL) comes from cooling the main natural gas stream (F-P) and/or from the initial refrigerant gas stream (G-0).

10. The process according to claim 1, wherein the pressure of the main natural gas stream (F-P) is higher than the critical pressure of the natural gas.

11. A process according to claim 1, wherein:

the temperature T1 lies in the range −40° C. to −60° C.;

the temperature T3 lies in the range −140° C. to −160° C.;

the temperature T4 lies in the range −10° C. to −40° C.;

the temperature T5 lies in the range −80° C. to −110° C.;

the temperature T8 lies in the range −80° C. to −110° C.;

the temperature T9 lies in the range −140° C. to −160° C.;

the pressure P0 lies in the range 5 MPa to 10 MPa;

the pressure P1 lies in the range 1 MPa to 3 MPa;

the pressure P2 lies in the range 2 MPa to 4 MPa; and the pressure P3 lies in the range 6 MPa to 10 MPa.

12. The process according to claim 1, wherein the refrigerant gas mostly comprises nitrogen.

13. The process according to claim 1, wherein the process is performed in a natural gas liquefaction installation at sea.

14. A natural gas liquefaction installation for performing the process according to claim 1 the installation comprising:

an ambient temperature expansion turbine for receiving a natural gas feed stream (F-0) and a portion of a second natural gas stream (F-2) coming from the delivery of a natural gas compressor and having an exhaust connected to an inlet of a main separator;

a main cryogenic heat exchanger for receiving natural gas (F-P, F-1, F-3) and refrigerant gas streams;

a compressor driven by the ambient temperature expansion turbine for receiving a first natural gas stream (F-1) from a main separator and having an outlet connected to the suction of the natural gas compressor;

an intermediate temperature expansion turbine for receiving a portion of a main natural gas stream (F-P) coming from the delivery of the natural gas compressor and connected to the inlet and to the outlet of the main cryogenic heat exchanger;

a compressor driven by the intermediate temperature expansion turbine to receive a third natural gas stream (F-3) from the main cryogenic heat exchanger;

a low temperature expansion turbine for the refrigerant gas connected to the inlet and the outlet of the main cryogenic heat exchanger; and a compressor driven by the low temperature expansion turbine and having an outlet connected to the suction of a refrigerant gas compressor.

15. The installation according to claim 14, wherein the natural gas compressor and the refrigerant gas compressor are driven by the same driver machine (ME) delivering the mechanical power needed to increase the pressure of the natural gas for liquefying and for compressing the fluids flowing in the three refrigerant cycles.

16. The installation according to claim 14, wherein the natural gas compressor is downstream from the compressors driven by the ambient temperature expansion turbine and the intermediate temperature expansion turbine, and wherein the refrigerant gas compressor is downstream from the compressor driven by the low temperature expansion turbine.

* * * * *